United States Patent [19]

Lonati

[11] 4,339,932

[45] Jul. 20, 1982

[54] MACHINE FOR KNITTING A TUBULAR FABRIC

[76] Inventor: Francesco Lonati, Via Valsorda, 28, Brescia, Italy

[21] Appl. No.: 83,129

[22] Filed: Oct. 9, 1979

[51] Int. Cl.[3] ..... D04B 9/06; D04B 15/92

[52] U.S. Cl. ..... 66/28; 66/95; 66/149 S

[58] Field of Search ..... 66/26, 28, 95, 149 R, 66/149 S

[56] References Cited

U.S. PATENT DOCUMENTS

| | | | |
|---|---|---|---|
| 3,063,275 | 11/1962 | Luchi | 66/149 S |
| 3,156,268 | 6/1970 | Foreman | 66/149 S |
| 3,214,944 | 11/1965 | Kienel | 66/149 S |
| 3,267,698 | 8/1966 | Poteat | 66/149 S |

FOREIGN PATENT DOCUMENTS

| | | | |
|---|---|---|---|
| 571936 | 1/1958 | Italy | 66/149 S |
| 622155 | 6/1961 | Italy | 66/149 S |
| 1040384 | 8/1966 | United Kingdom | 66/149 S |
| 1047123 | 11/1966 | United Kingdom | 66/149 S |
| 1055701 | 1/1967 | United Kingdom | 66/149 S |
| 224742 | 5/1969 | U.S.S.R. | 66/149 S |

*Primary Examiner*—Wm. Carter Reynolds

*Attorney, Agent, or Firm*—Guido Modiano; Albert Josif

[57] ABSTRACT

Machine for knitting a tubular fabric, in particular stocking articles, comprising a needle cylinder, a cylinder holder, a dial, suction and discharge ducts for the produced tubular fabric and means for driving the cylinder holder. A shaft extends coaxially through the needle cylinder and the cylinder holder and is affixed to the dial. A tube-like body is mounted coaxially within the cylinder holder wherewith it rotates. The tube-like body is displaceable axially in the cylinder holder from a position whereat it is coupled directly to and made rigid for rotation with the shaft, to a position whereat it forms with the shaft at least one annular passage for communication with the suction and discharge ducts for the produced tubular fabric. A control member is provided of essentially lever-like configuration for axially displacing the tube-like body.

4 Claims, 8 Drawing Figures

MACHINE FOR KNITTING A TUBULAR FABRIC

BACKGROUND OF THE INVENTION

This invention relates to a machine for knitting a tubular fabric, in particular stocking articles, of the type which comprises a needle cylinder mounted coaxially to a cylinder holder, wherewith it rotates about a common vertical axis, a dial carried above the needle cylinder in a predetermined spaced-apart relationship therewith and set for rotation about said vertical axis, a tubular fabric intake and discharge duct in fluid conducting communication, on one side, with the inside of said cylinder holder, and on the other side with a suction source, and means for powering the cylinder holder. To produce a tubular fabric on a machine of the aforesaid type (commonly referred to as a circular knitting machine), it is mandatory that the dial and needle cylinder rotate in preestablished timed or in-phase relationship to each other and maintain such timing throughout the production or knitting cycle.

Any undesired out-of-time, or out-of-phase, condition, however small, generally results in such plainly visible faults in the fabric as to require discarding of the end product.

In currently available circular knitting machines, the operational rotary movements of the needle cylinder and dial are derived from a common drive shaft. In general, whereas the rotation of the needle cylinder is obtained through a pair of bevel gears, one whereof is keyed to the drive shaft and the other to the cylinder holder, the rotation of the dial is derived from said drive shaft through a drive train having rigid component members and which extends outside the machine and, in most favorable of cases, includes at least three pairs of bevel gears. It will be appreciated that, in spite of a most careful manufacturing of the bevel gears, their meshing unavoidably involves the presence of backlash, which increases with wear as the machine is being operated. In the drive train from the drive shaft to the dial, said backlash of each bevel gear pair adds up in a sort of negative synergism, with a resulting real danger of the dial going out of time or phase with respect to the needle cylinder.

That danger, which grows continuously in time as the bevel gear wear progresses, has been unavoidable heretofore, to the point that a more or less pronounced production waste is normally accepted (albeit forcibly so) in the art. In order to limit the magnitude of said production waste or loss, the experts' attention has concentrated so far upon improvements to the bevel gear manufacturing technology, as well as the meshing thereof, and on an increase of the maintenance frequency, such as to prevent the damage induced by wear. However, whereas on one side, the production loss caused by the out-of-phase relationship between the dial and needle cylinder, due essentially to the aforementioned drive train remains substantial, on the other side, the costs related to the manufacturing and maintenance of the bevel gear pairs and, more generally, of the whole drive train are increased considerably.

Another major drawback is the space requirements which result from the currently adopted arrangement of said drive train externally to the circular knitting machine.

In the German published patent application (German Auslegeschrift) No. 1,103,505, there is disclosed a circular knitting machine of large diameter, wherein the operational rotary movement of the dial is derived from the motion of the cylinder holder through a drive train which extends inside of the cylinder holder; in that machine, the resulting tubular product is cut, as it is being knitted, along a generatrix thereof and discharged from the machine in the form of a flat fabric. That lengthwise cutting operation is a strict necessity, according to the teachings of the German patent, as otherwise it would not be possible to discharge the tubular fabric, because owing to its encircling the drive train right from the start, it would be withheld by the drive train itself, and get caught and entangled within the machine.

SUMMARY OF THE INVENTION

The problem with which this invention deals is that of providing a machine for knitting a tubular fabric, in particular hoses or stocking articles, having such constructional and operational features as to overcome the technical and economical drawbacks cited above with reference to the prior art status.

For the solution of this problem, according to one aspect of the present invention, the machine comprises:

a shaft extending coaxially through said needle cylinder and said cylinder holder, with the inner walls whereof it forms an annular chamber, said shaft being rigid for rotation at the top with said dial;

an essentially tube-like body mounted coaxially within at least a part of a tubular body rigid and coaxial with said cylinder holder, said tube-like body being rotatable with said tubular body and displaceable axially with respect thereto from a position whereat it is coupled coaxially and rigid for rotation with said shaft, to a position whereat it forms with said shaft at least one annular passage for communicating said annular chamber with said intake and discharge duct for the produced tubular fabric;

an essentially lever-like control member for axially displacing said tube-like body.

According to a first embodiment of the invention, said tube-like body has a bottom end portion which extends outside of the cylinder holder and is in sealed sliding and rotating engagement with said intake and discharge duct for the produced tubular fabric, and another end portion, internal to said cylinder holder, provided with clutch means intended for detachably engaging corresponding mating counter-clutch means formed at the free bottom end of said shaft, said tube-like body being axially displaceable from a position whereat it is rigid for rotation with said shaft by mutual engagement of said clutch means and mating counter-clutch means, to a position whereat its top end is spaced apart, in the direction of said axis, from the free bottom end of said shaft.

According to a preferred embodiment, a machine for knitting a tubular fabric, according to this invention, is characterized in that said shaft has a portion, extending coaxially within said cylinder holder, which comprises one top shaft section and at least one bottom shaft section mutually spaced apart by an intermediate section having a reduced diameter cross-section, each said top and bottom shaft section being provided, at diametrically opposite positions, with two longitudinally extending grooves, and in that said essentially tube-like body is provided internally with two tooth pairs mutually spaced apart, in the direction of said axis, by a predetermined distance, said tooth pairs being operative to engage detachably the grooves of the top section and respectively bottom section of said shaft portion, the teeth of each pair extending radially and on diametrically opposite sides of said tube-like body and having free facing ends which are mutually spaced apart by a greater distance than the diameter of the reduced cross-section shaft section.

BRIEF DESCRIPTION OF THE DRAWINGS

Further features and advantages of the invention will be more clearly apparent from the following description of an exemplary embodiment of a machine for knitting a tubular fabric, in particular hoses or stocking articles, according to the invention, with reference to the accompanying drawings, where.

DESCRIPTION OF THE PREFERRED EMBODIMENTS

Figure 1:
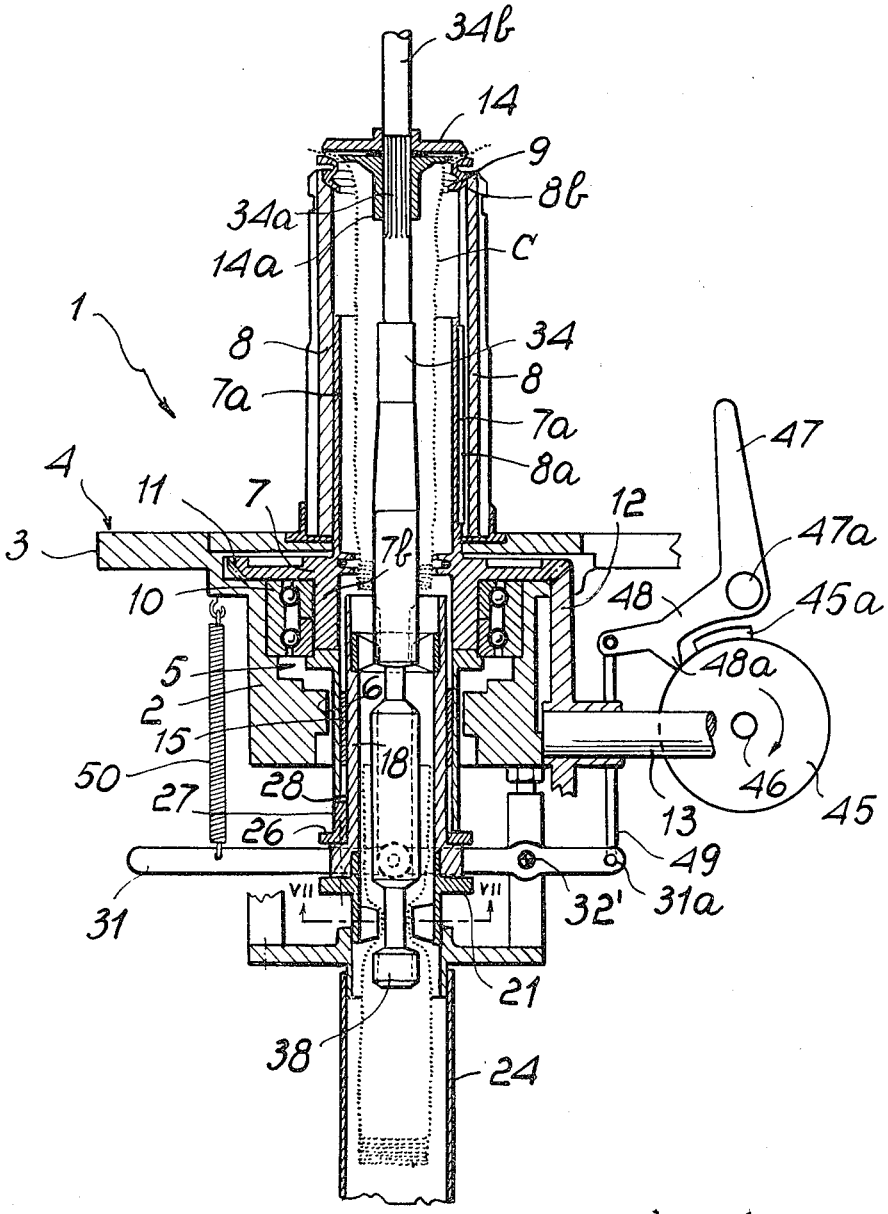
FIG. 1 shows schematically in a vertical section a machine according to this invention in an operative stage thereof.

With reference to FIGS. 1 to 4 of the drawings, there is generally indicated at 1 a machine for knitting tubular fabric, in particular stocking articles. In that machine, a machine bed or head 2, anchored to the floor in a conventional manner not shown, comprises an essentially cylindrical body having its axis vertically arranged and being provided at the top with a flange portion 3 which defines a resting surface 4 and has a through aperture 5 extending axially thereto. An annular rim 6, formed coaxially within the head 2, divides said aperture 5 into two coaxial contiguous portions, an upper one 5*a* and lower one 5*b*.

The reference numeral 7 denotes a needle cylinder holder, positioned coaxially inside the aperture 5 in the head 2, whereby it is carried rotatably with the interposition, for example, of a bearing 10. A conical or bevel gear 11, having a predetermined diameter and number of teeth, is attached coaxially external to the cylinder holder 7 (or formed integrally therewith). This gear 11 defines in the cylinder holder 7 a lower portion 7*b*, of shorter length, which fully extends through the portion 5*a* of the aperture 5 in said head 2, and an upper portion 7*a*, of longer length, which extends externally to the head 2 above the resting surface 4 thereof. The gear 11 is in mesh engagement with a gear 12 located externally to the head 2 and keyed to a drive shaft 13.

A needle cylinder 8 is detachably and coaxially mounted about the upper portion 7*a* of the cylinder holder 7. The needle cylinder 8 is made rigid for rotation with the cylinder holder 7 by means of a conventional coupling means, e.g. a key 8*a*. At the upper or top mouth 8*b* of the needle cylinder 8, there is rigidly and coaxially associated, in a conventional manner, a flanged bush member 9, intended for cooperation with a dial, generally and schematically indicated at 14. The dial may be either a welt dial provided with welt hooks or a needle dial provided with needles. The type of the dial is however unimportant for the present invention.

A cylindrical tube or tubular body 15 is positioned coaxially within the aperture 5 of the head 2, contiguously to the cylinder holder 7. More specifically, said tubular body 15, which has an outside diameter only marginally smaller than the inside diameter of the annular rim 6, formed in said head 2, is provided at the top with a circular flange portion 16, butt joined to the lower or bottom end of the portion 7*b* of the cylinder holder 7, through a plurality of screws 17. The tube 15, which is accordingly rigid rotation-wise with the cylinder holder 7, has a predetermined length and extends downwardly outside the head 2.

Within the tubular body 15, there is coaxially and rotatably mounted, with the interposition of a bearing schematically indicated at 18*a*, a tube-like body or sleeve 18. This tube-like body 18, having a preset inside diameter and being enabled to perform guided axial movements with respect to the tube 15, is provided with a lower end section extending to the outside of said tube 15 and formed with a flanged edge 19, with a predetermined outside diameter equal to or only slightly greater than the outside diameter of the tube 15.

The reference numeral 20 denotes generally a barrel (hereinafter termed "lower entraining barrel") which is attached coaxially to the lower or bottom end of the tube 18. In particular, said barrel 20 is equipped, at an intermediate position thereof, with a flange 21, attached to the free end of the edge 19 of the tube 18 through a plurality of screws 22. This barrel 20, which has an inside diameter equal to the inside diameter of the tube 18, extends partly within said tube and partly outside of it.

Figure 8:
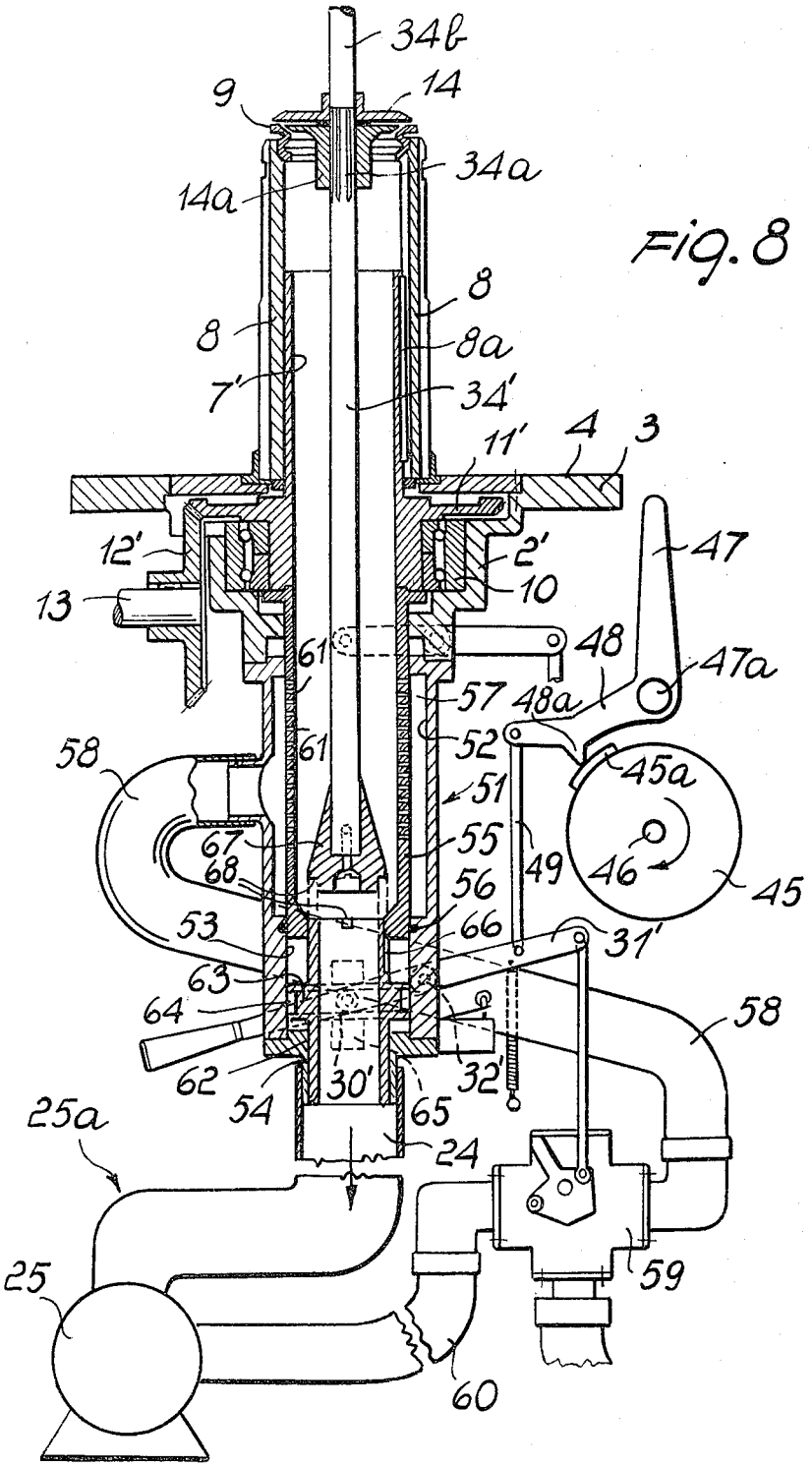
FIG. 8 shows schematically a modification of the machine of the preceding Figures.

This latter portion of the barrel 20 extends coaxially, over a predetermined length and with the interposition of a gasket 23*a*, into the mouth 23 of a suction duct, schematically indicated at 24, which is equipped with a product discharge device 25*a* connected to a suction source 25 (FIG. 8). The duct 24 is thus in fluid conducting communication with the inside of the cylinder holder 7. It should be noted that the barrel 20, which is practically integral with the tube 18, is mounted in the mouth 23 of the duct 24 with the possibility of axially moving along and rotating about its own axis.

Figure 5:
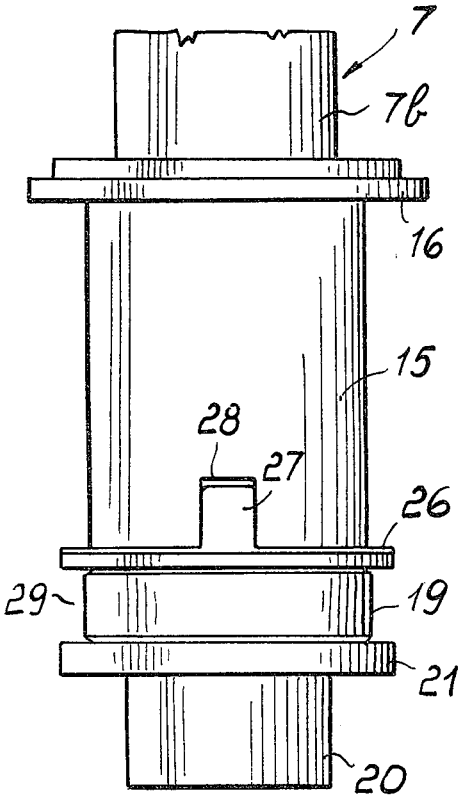
FIGS. 5 to 7 are enlarged scale views of some details of the construction of the machine illustrated in the previous figures.
Figure 6:
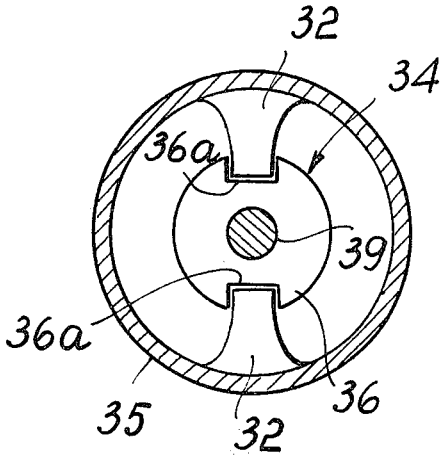

To the tube 18 itself, on the side of said edge 19 thereof, opposite to the barrel 20, there is attached externally and coaxially a ring 26 having an outside diameter dimension equal to the outside diameter of said flange 21. This ring 26 (FIG. 5) is formed with a tooth 27 of predetermined circumferential extension and thickness, which tooth engages with a respective recess 28 formed in a lower end section of the tube 15. The engagement of the tooth 27 with the recess 28 is such as to make the tube 18 and lower barrel 20 rigid for rotation with the the tube 15, and accordingly the cylinder holder 7.

The ring 26 and flange 21 of the lower entrainment barrel 20 define, with the outside wall of the edge 19 of said tube 18, an annular groove, indicated at 29, wherein an idle roller 30 is arranged which is carried by a lever 31. This lever 31 is pivoted at 32' to the stationary structure of the head 2 of the machine according to the invention. By operating the lever 31, the assembly or unit comprising the tube 18 and lower entrainment barrel 20 is displaceable axially with respect to the tube 15 and mouth 23 of the duct 24.

Said tube 18/barrel 20 assembly is provided internally with two pairs of teeth, an upper one 32,32 and a lower one 33,33, which are intended for engaging and rotatively driving a shaft 34, in a manner that will be explained hereinafter.

Figure 7:
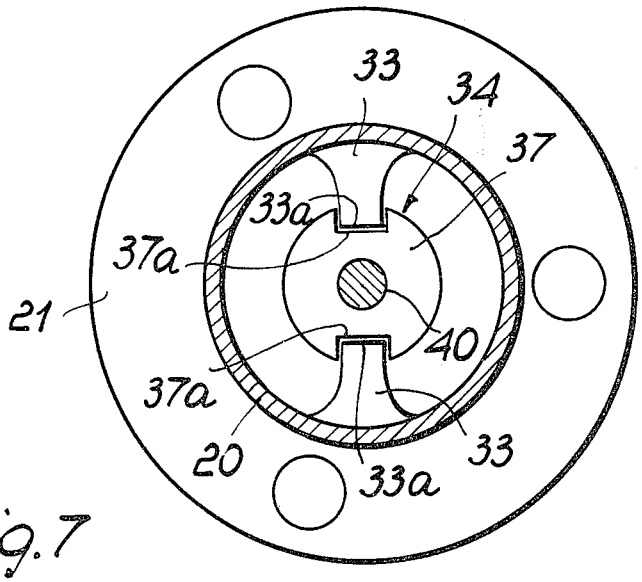

More specifically, and in accordance with a preferred embodiment, the teeth 33 of the lower tooth pair in said tube 18/barrel 20 assembly comprise respective plate-like projections, lying in a common axial plane of said assembly and formed internally to the entrainment barrel 20 close to the lower portion thereof which is engaged in the mouth 23 of the suction duct 24. Said projections have a predetermined thickness and a profile which has essentially a rounded up isosceles trapezium shape, with respective minor bases 33*a*,33*a* (FIG. 7) facing each other and spaced apart by a predetermined distance and parallel to the axis of the tube 18/barrel 20 assembly.

The teeth 32 of the upper tooth pair in said assembly are similar to the teeth 33 described hereinabove, and are coplanar therewith. According to a preferred embodiment, the teeth 32 are formed inside an annular bush 35, attached coaxially to the tube 18 inside, at a predetermined distance from the tooth pair 33 described above. A separate tubular member 35*a* may be provided above annular bush 35 to extend into the cylinder holder 7 for defining a guiding tube favouring downward movement of the knitted fabric. Member 35*a* has not been shown in FIGS. 1 and 3 for reasons of clarity of representation.

The shaft 34, which extends coaxially through the tube 18/barrel 20 assembly, the cylinder holder 7 and the dial 14 and defines an annular chamber with the cylinder holder 7 has an upper or top portion 34*a* with grooved profiles (FIGS. 1 and 3), whereby it is internally coupled for rotation with a shank 14*a* which equips axially the dial 14. The portion 34*a* with grooved profiles of the shaft 34 extends above the dial 14 with an end section 34*b* intended for engagement by a supporting assembly (not shown because of conventional configuration). The shaft 34 is therefore axially non-displaceable within the cylinder holder 7 and the needle cylinder 8.

That portion of said shaft 34 which extends through the head 2 of the machine of the embodiment of FIGS. 1 to 7, comprises three successive sections 36,37,38 (FIG. 2) having the same outside diameter and separated by respective sections 39,40 having reduced diameter cross-sections, in particular cross-sections with smaller diameter than the predetermined distance separating the facing sides of the teeth 32,33 of the upper, respectively lower, tooth pairs in the tube 18/barrel 20 assembly.

The upper section 36 and lower one 38 are provided, at diametrically opposite locations, with longitudinally arranged identical grooves, respectively 36*a*,36*a* and 38*a*,38*a*; these grooves have a width dimension equal to the thickness dimension of the teeth 32,33 and predetermined depths adapted for accommodating predetermined end portions of said teeth. In the drawing figures, the section 37 of the shaft 34 also appears as formed with similar longitudinal grooves 37*a*, 37*a*, but these grooves are merely due to manufacturing requirements.

The length of the grooved sections 36,38 and their distance along the shaft 34, are selected such that on the occasion of axial movements of the tube 18/barrel 20 assembly, prior to the teeth 32 coming out of engagement with the grooves 36*a*,36*a* of the respective section 36 of the shaft 34, the teeth 33 already engage the grooves 38*a*,38*a* of the respective section 38, and vice-versa. Thus, continuous rotation of the shaft 34 is ensured, and accordingly of the dial 14 during said axial movements of the assembly 18/20, the rotation occurring in synchronism with the rotation of the needle cylinder 8.

Figure 2:
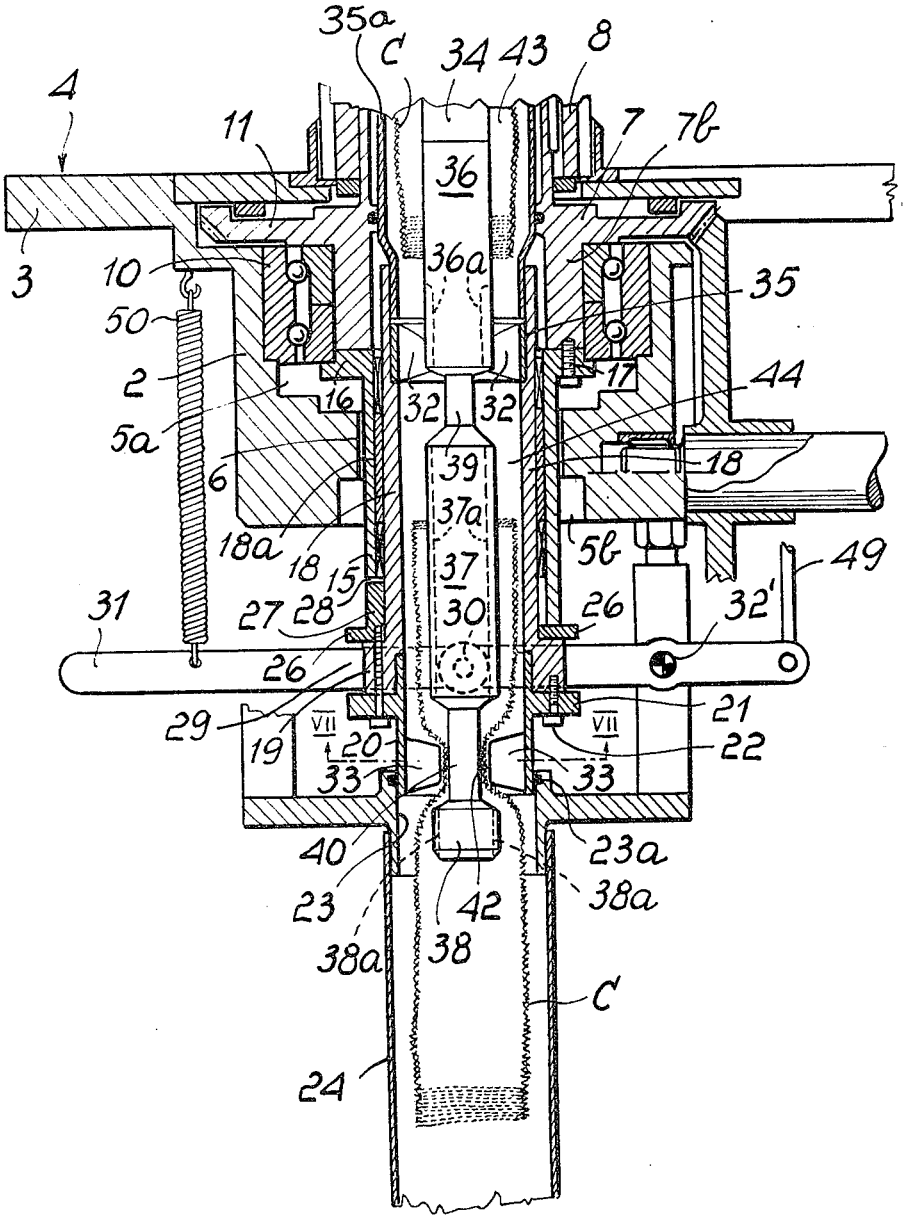
FIG. 2 is an enlarged scale view of a portion of FIG. 1.
Figure 3:
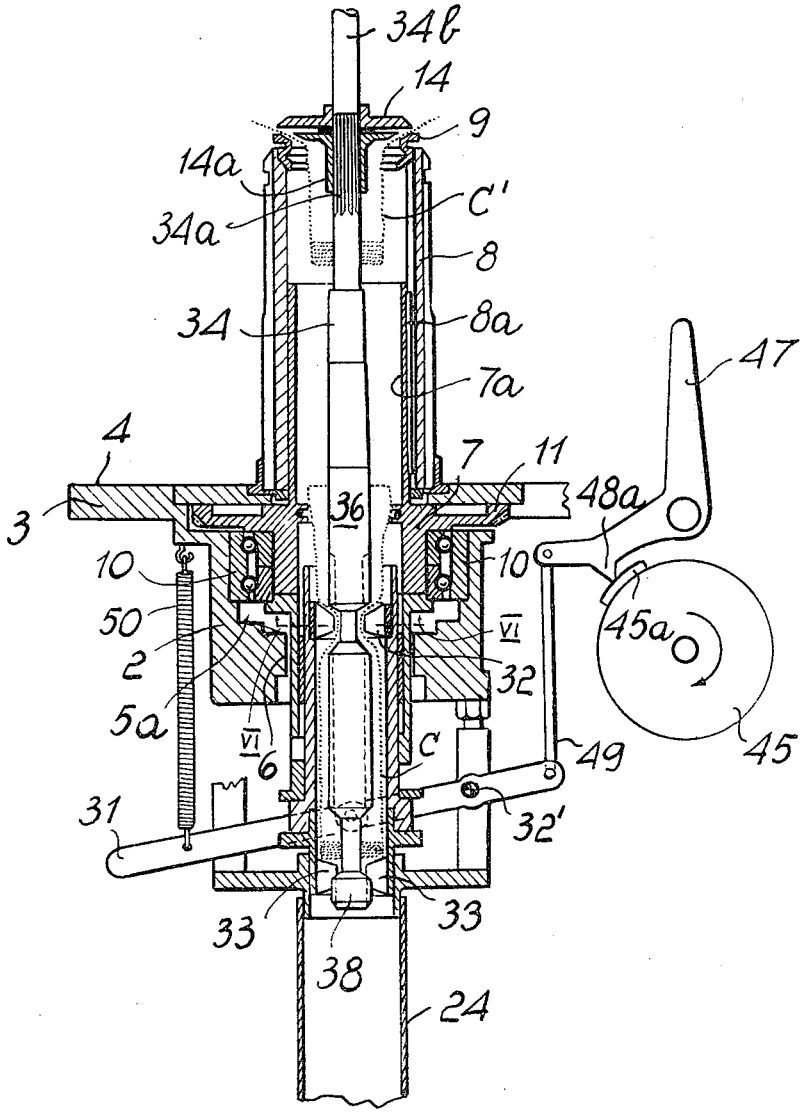
FIG. 3 shows schematically the same machine as shown in FIG. 1 but in a different operative stage thereof.
Figure 4:
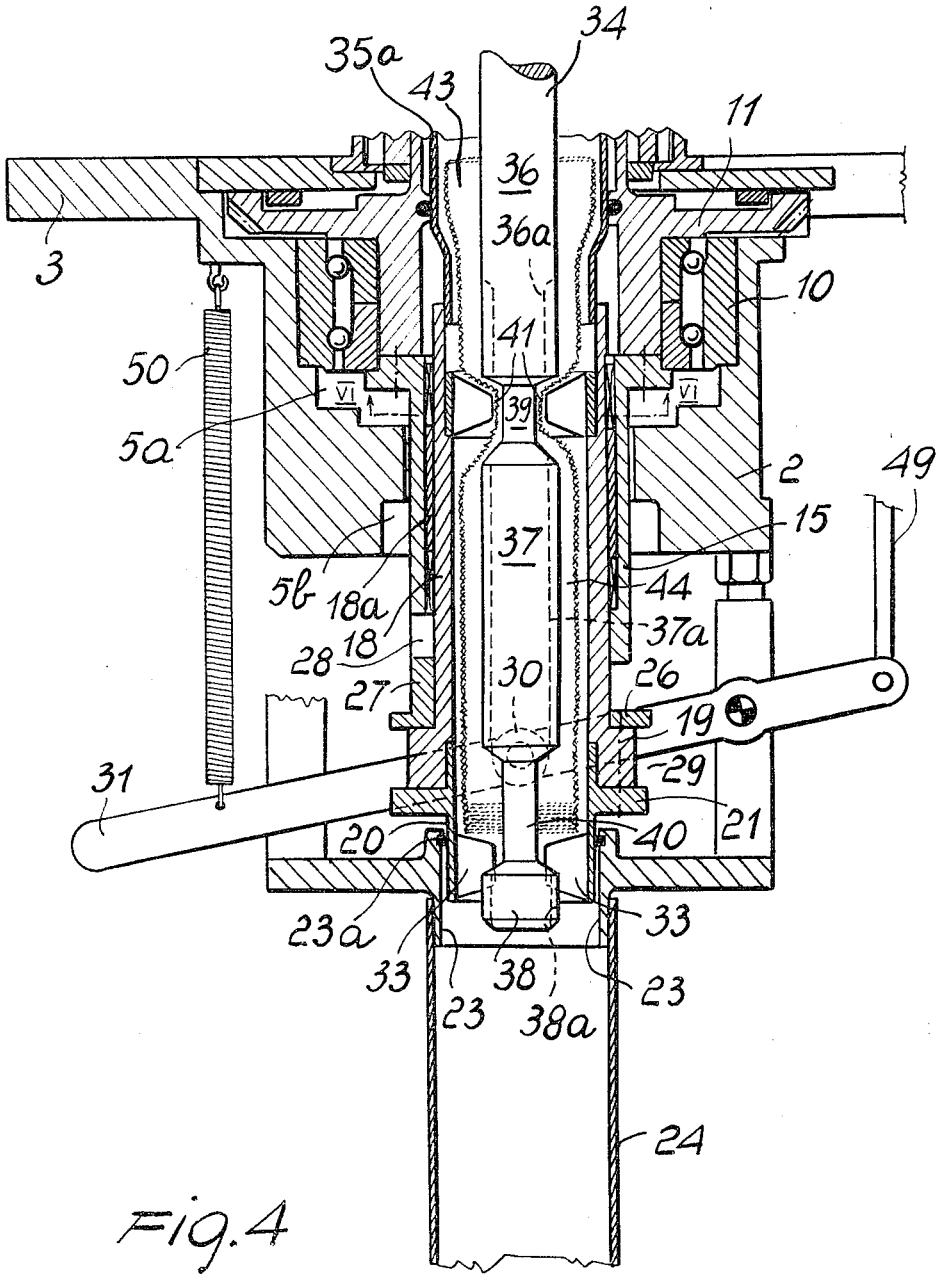
FIG. 4 is an enlarged scale view of a portion of FIG. 3.

Moreover, the magnitude of the axial movements of said assembly, the lengths of the grooved sections 36 and 38, the size of the teeth 32,33 as measured along the rotation axis of the shaft 34, and the lengths of the reduced diameter sections 39 and 40, are selected such that as, during said axial movements of the assembly 18/20, the pairs of teeth 32 or 33 are positioned at the reduced diameter sections 39, respectively 40, between said teeth and said sections 39,40 there are defined respective axial annular passages 41, 42 of a predetermined size (FIGS. 4 and 2).

The passage 41 provides communication between the annular chamber 43 formed between the cylinder holder 7 and shaft 34 and the annular chamber 44, formed between the tube 18 and the section 37 of said shaft 34. The passage 42 provides communication between said chamber 44 and the suction duct 24.

The axial movements of the tube 18/barrel 20 assembly are controlled by the angular movements of the lever 31 about its pivot axis 32. For the angular movements of this lever 31, according to a preferred embodiment, a cam is utilized, shown schematically at 45, which is mounted an a power shaft 46 and has a raised profile portion 45*a*. With this cam, a crank lever 47 cooperates which is pivoted at 47*a* and one arm 48 whereof is provided with a projection 48*a* constituting the follower for said cam. The free end of said arm 48 is connected, through a connecting rod 49, to the free end 31*a* of the lever 31. The angular movements in a counterclockwise (as viewed in the figures) direction of said lever 31 are antagonized by a spring 50. Obviously, for the angular movements of the lever 31, other control systems may be utilized which are known per se and well within the abilities of an expert in the art. It should be noted that the magnitude of the angular movements of the lever 31 as controlled by the cam 45, whilst on one side produce said engagement and disengagement movements of the tooth pairs 32,33 with and from the respective grooves 36*a*, 38*a*, on the other side cause no disengagement of the tooth 27 from its respective recess 28.

The machine just described operates as follows. In a condition of start of the production cycle (FIGS. 1 and 2), the follower 48*a* of the crank lever 47 contacts the low profile of the cam 45, thereby the lever 31 is held in the "raised" position by the spring 50. Consequently, the tube 18/barrel 20 assembly is fully inserted into the tube 15 and the upper teeth 32, 32 of said assembly engage in the corresponding grooves 36*a*,36*a* of the grooved section 36 of the shaft 34. The lower teeth 33,33 of said tube 18/barrel 20 assembly are positioned at the section 40 of reduced diameter in said shaft 34, thereby the passage 42 formed therebetween is open both to the chamber 44 and the suction duct 24.

At this stage, the following members are activated simultaneously: the suction fan 25, drive shaft 13, and shaft 46 for rotating the cam 45. From the drive shaft 13, the operative motion is transmitted to the needle cylinder 8 through the bevel gears 12 and 11 and cylinder holder 7, whilst through that same cylinder holder 7, the tube 15 rigid therewith, the tooth 27, tube 18, and teeth 32,32 engaging in the respective grooves 36a,36a, said motion is transmitted to the shaft 34 which rotates the dial 14 rigidly therewith. The machine thus begins to knit a tubular fabric, such as a hose or stocking, as shown schematically at C in FIG. 1, which is held taught by the suction applied by the fan 25. During this per se known knitting step, the follower 48a of the crank lever 47 runs over the low profile of the cam 45 which rotates at a predetermined speed. Whilst the rotary movement of the machine is continuous, the knitting of this first portion of the fabric is discontinued by cutting in a per se known manner the yarn(s) upon the tubular fabric reaching a predetermined length. It should be noted that upon completion of this operation (cutting of the yarn(s)), the cam 45 has already completed one revolution about its own axis, such as to bring closer to the follower 48a the raised profile 45a. After the cutting of the yarn, the tubular fabric, notwithstanding the suction applied by the fan 25, is withheld inside the chamber 43 by the upper teeth 32,32 of the tube 18, which teeth are still engaging the respective grooves 36a, 36a of the grooved section 36 of the shaft 34. However, immediately after, or simultaneously with the cutting of the yarns, the follower 48a of the crank lever 46 is lifted off the raised profile 45a of the cam 45, thereby the lever 31 is rotated counterclockwise against the spring 50. Thus, the tube 18/barrel 20 assembly is forcibly moved downwards with respect to the tube 15, which movement is accompanied by a disengagement movement of the teeth 32,32 from the corresponding grooves 36a, 36a and engagement movement of the lower teeth 33,33 with the respective grooves 38a, 38a of the end section 38 of the shaft 34. As already mentioned hereinabove, prior to the teeth 32 being fully released from the respective grooves 36a, 36a, the teeth 33 have already engaged the grooves 38a,38a, thereby the rotary motion of the dial 14 is not interrupted. With said displacement (disengagement) of the upper teeth 32,32, the latter move to a position at the section 39 of reduced diameter of the shaft 34, thereby the passage 41 formed therebetween is opened. Consequently, and owing to the continuous suction provided by the fan 25, the tubular fabric which was previously withheld by the teeth 32 being engaged in the grooves 36a,36a, is passed into the chamber 44, wherein it is withheld by the teeth 33 being engaged in the grooves 38a,38a. During this transfer movement, the knitting of a second section C' of tubular fabric (or second hose) is started, while the follower 48a of the crank lever 47 has completed its travel along the raised portion of the cam 45. Upon this follower resuming its contact with the low profile of the cam 45, the spring 50 brings the lever 31 back to its starting position of the cycle and the tube 18/barrel 20 assembly is fully reinserted into the tube 15. Upon reinsertion of that assembly, the upper teeth 32 once again engage the corresponding grooves 36a,36a, whilst the lower teeth 33 of that assembly disengage from the grooves 38a,38a and position themselves at the reduced diameter section 40 of the shaft 34. Consequently, while retaining the continuous rotary motion of the machine in operation, the first section (or first hose) of the tubular fabric, previously withheld by the teeth 33 being engaged in the grooves 38a,38a, is passed now through the passage 42 in the suction duct 24 and hence to a subsequent handling station.

It should be noted that with the circular machine of this invention, one is enabled to produce, as and when required, the so-called "closed tip" of a tubular article (hose or stocking). In fact, for this purpose, it will be sufficient that the lever 31 be actuated manually to fully disengage the tooth 27 of the barrel 20 from the corresponding recess 28. As a result, the tube 18/barrel 20 assembly is released from the tube 15, rigid with the cylinder holder 7. Whilst said assembly, and with it the dial 14, can be stopped in a conventional manner, the needle cylinder 8 continues to rotate for a predetermined number of revolutions. Thus, the desired "tip closure" is obtained in the tubular fabric at the dial 14.

FIG. 8 illustrates a variation of the machine described above with reference to FIGS. 1 to 7. In this figure, elements which are identical to those described with reference to FIGS. 1 to 7 are denoted with like reference numbers while the element which are similar and equivalent to those of the machine of FIGS. 1 to 7 are denoted with like reference numbers followed by a prime.

According to this variation, the head or stationary support 2' of the machine is extended coaxially downwards by means of a tubular body 51 comprising essentially three successive sections 52,53,54 having their inside diameter of decreasing sizes. The cylinder holder 7' is extended coaxially downwards by means of a cylindrical tubular body 55, having the same inside diameter as said cylinder holder, and its outside diameter equal to the inside diameter of the intermediate section 53 of the cylindrical body 52 described above.

This cylindrical body 55, a lower portion whereof is rotatably engaged, with the interposition of a gasket 56, in said intermediate section 53, forms together with the upper section 52 of the cylindrical body 51, an annular interspace 57 in fluid conducting communication, through a further suction duct 58 and a shut-off valve schematically indicated at 59, with a suction duct 60. The inside of the cylindrical tubular body 55, and accordingly of the cylinder holder 7', is in air communication with the interspace 57 through a plurality of radial holes 61 formed in the cylindrical tubular body itself. There is generally indicated at 62 a cylindrical tube or tube-like body rotatably engaged in sealed relationship in the lower reduced diameter section 54 of the cylindrical body 51, with respect whereto it is also displaceable axially. This tube 62 is provided with an external and coaxial annular edge or rim 63, wherein an annular groove 64 is defined circumferentially which is intended for engagement by an idle roller 30' carried by the lever 31' extending externally to the cylindrical body 51. In particular, in order to allow for the engagement of the idle roller 30' and groove 64, at the intermediate portion 53 of the cylindrical body 51, there is formed a longitudinal slot 65 of length and width dimensions which are predetermined. The tube 62 is made connected at the top, e.g. through a spline profile coupling 66, with the cylindrical tubular body 55 for rotation therewith, whilst it is displaceable axially with respect to said tubular body.

The shaft 34', which extends internally to the cylinder holder 7' and cylindrical tubular body 55, is provided at the bottom with a truncated cone head 67 which is tapered towards the top and the lower free end whereof is spaced apart from the bottom of the cylindrical tubular body 55 by a predetermined distance. On the upper free end portion, the tube-like body 62 is provided with conventional coupling means for butt clutch coupling thereof with mating coupling means 68 provided on the lower free end of the truncated cone head 67. By effecting that butt coupling, the shaft 34' (and therefore the dial 14) is made rigid for rotation with the tube 62, and accordingly the cylinder holder 7' and needle cylinder 8.

After establishing that connection or coupling, by actuating the lever 31', e.g. as described with reference to FIGS. 1 to 4, and after starting the drive shaft 13, the machine begins its knitting cycle for the production of tubular fabric (or hose or stocking), and during that cycle, by suitably manipulating the valve 59, a suction is maintained within the machine through the duct 58, annular interspace 57, plurality of holes 61, whereas the suction through the duct 24 is cut off. Upon completion of the article, simultaneously with the cutting of the yarn(s), the tube 62 is disengaged from the shaft 34' such as to open communication between the inside of the cylinder holder 7' and the suction and discharge duct 4. At the same time, by suitable manipulation of the valve 59, the suction is discontinued through the duct 58, whilst the suction is activated through the duct 24. The completed article is thus sucked through said duct and conveyed to a successive handling station.

I claim:

1. A machine for knitting tubular fabrics, in particular stocking articles, of the type comprising a needle cylinder, a cylinder holder coaxial with said needle cylinder and rigid for rotation therewith about a vertical axis, a dial at the top of said needle cylinder at a predetermined distance away therefrom and rotatable about said vertical axis, a suction and discharge duct for a knitted tubular fabric, said suction and discharge duct being in fluid conducting communication on one side with the inside of said cylinder holder and on another side with a suction source, and means for driving said cylinder holder, the machine further comprising:

a tubular body coaxial and rigid with said cylinder holder below thereof;

a shaft extending coaxially through said needle cylinder, said cylinder holder and said tubular body and defining with said cylinder holder an annular chamber, said shaft having a top portion rigid with said dial and being axially non-displaceable within said cylinder holder and said needle cylinder;

an essentially tube-like body whereof at least a part is arranged coaxially within said tubular body and rotatable therewith, said tube-like body being displaceable axially between a first position whereat it is rigid for rotation with said shaft to cause rotation of said dial in synchronism with said needle cylinder, and a second position whereat it forms with said shaft at least one annular passage for communication between said annular chamber and said suction and discharge duct for said knitted tubular fabric;

a control means of essentially lever-like type for axially displacing said tube-like body.

2. A machine according to claim 1, wherein said tube-like body has a lower end portion extending externally to said cylinder holder and said tubular body and slidably and pivotally engaging in sealed relationship the inside of said suction and discharge duct for said knitted tubular fabric, and an upper end portion located inside said tubular body and having coupling means for detachably engaging correspondingly mating coupling means formed at a lower end portion of said shaft, whereby in said first position said coupling means and said mating coupling means mutually engage each other and in said second position said upper end portion is spaced apart, in the direction of said vertical axis, from said lower end portion of said shaft and said coupling means are disengaged from said mating coupling means.

3. A machine according to claim 2, further comprising a further suction duct in fluid conducting communication, on one side, with said suction source, and on another side, with the inside of said cylinder holder, through a plurality of holes formed in said tubular body.

4. A machine according to claim 1, wherein said shaft has a portion within said tubular body comprising an upper shaft section and at least one lower shaft section, said sections being mutually spaced apart by an intermediate section having a reduced diameter cross-section, each said upper and lower shaft sections having, at diametrically opposite locations, two longitudinally extending grooves, and wherein said essentially tube-like body has internally two pairs of teeth, said teeth pairs being mutually spaced apart, in the direction of said vertical axis, by a predetermined distance and adapted for engaging in a detachable manner said grooves in said upper shaft section, respectively lower shaft section, said teeth of each of said pairs extending radially on diametrically opposite sides of said tube-like body and having facing free ends, said facing free ends being mutually set apart by a distance greater than the diameter of said reduced diameter cross-section of said intermediate section.

* * * * *